United States Patent [19]

Schneider

[11] Patent Number: 4,989,745

[45] Date of Patent: Feb. 5, 1991

[54] CONTAINER

[76] Inventor: Bernardus J. J. A. Schneider, Zuideindseweg 54, 2645 BH Delfgauw, Netherlands

[21] Appl. No.: 361,220

[22] Filed: Jun. 5, 1989

[30] Foreign Application Priority Data

Jan. 19, 1989 [EP] European Pat. Off. ..... 89200117.3

[51] Int. Cl.[5] ..... B65D 51/16

[52] U.S. Cl. ..... 220/208; 220/203; 215/260; 215/311; 277/205; 141/65; 116/270

[58] Field of Search ..... 206/315.9, 508, 520; 220/203, 208, 378; 215/228, 260, 311; 277/2, 205; 141/65; 116/268, 270; 99/472

[56] References Cited

U.S. PATENT DOCUMENTS

| | | | |
|---|---|---|---|
| 1,384,780 | 7/1921 | Sager . | |
| 2,049,872 | 8/1936 | Sera | 230/239 |
| 2,303,766 | 12/1942 | Scherbak | 141/65 |
| 2,436,849 | 3/1948 | Billetter | 226/82 |
| 2,604,507 | 7/1952 | Tyson | 220/378 |
| 3,135,411 | 6/1964 | Osborne | 141/65 |
| 3,313,444 | 4/1967 | Katell | 141/65 |
| 3,414,160 | 12/1968 | Weber | 141/65 |
| 3,430,799 | 3/1969 | Maier | 220/378 |
| 4,181,314 | 1/1980 | Cerf et al. | 277/205 |
| 4,206,845 | 6/1980 | Christian | 206/508 |
| 4,249,583 | 2/1981 | Lundbladh | 141/65 |
| 4,266,550 | 5/1981 | Bruner | 116/270 |
| 4,278,114 | 7/1981 | Ruberg | 141/65 |
| 4,287,819 | 9/1981 | Emerit | 141/65 |
| 4,690,414 | 9/1987 | Haaland | 277/205 |
| 4,700,842 | 10/1987 | Grusin | 206/508 |
| 4,763,803 | 8/1988 | Schneider | 215/260 |
| 4,830,182 | 5/1989 | Nakazato et al. | 206/334 |
| 4,844,263 | 7/1989 | Hadtke | 206/508 |

FOREIGN PATENT DOCUMENTS

| | | |
|---|---|---|
| 623620 | 12/1935 | Fed. Rep. of Germany . |
| 200360 | 10/1938 | Switzerland . |

*Primary Examiner*—David T. Fidei

*Attorney, Agent, or Firm*—Parmelee, Bollinger & Bramblett

[57] ABSTRACT

A container capable of being evacuated by a pump which is removably and sealably attached thereto comprises a cover having a removable valve mounted therein and a container body which is adapted to receive the cover. A compressible indication member is positioned between the periphery of the cover and container body, the visibility of which from the outside of the container provides an indication of the evacuation state of the container. The cover and the container body are movable relative to each other which movement is dependent on the pressure difference between the interior and the surroundings of the container whereby the deformation of the indication member provides an indication of the amount of pressure in the container.

16 Claims, 2 Drawing Sheets

CONTAINER

FIELD OF INVENTION

This invention relates to an evacuable container, and more particularly, to such a container having at least two container members, a removable valve mounted in one of said members and a deformable indication means mounted between the two members which provide an indication of the pressure in the container with respect to its surroundings or environment external to the container.

BACKGROUND OF THE INVENTION

A number of containers of the type capable of evacuation are known for example, one type is illustrated in U.S. Pat. No. 4,249,583. Such containers may be used for storing foodstuffs, chemicals, paints, and the like as the preservation process is enhanced by the removal of air from the container after the contents have been placed therein and prior to storage. Many such containers, however, have the disadvantage of not showing or providing for easily checking whether evacuation is present in the container or the extent of such evacuation. In addition, many such structures are complex, have a large number of parts, or are difficult to assemble, evacuate and/or clean.

SUMMARY OF THE INVENTION

Accordingly, it is an object of this invention to provide a new and improved evacuable container in which the disadvantage of being unable to check the interior pressure of such a container is removed in a simple and effective way.

Another object of this invention is to provide a new and improved evacuable container which is simple in construction, easy to assemble and evacuate, and easy to disassemble and clean.

Still a further object of this invention is to provide a new and improved evacuable container which provides a visual indication of the interior pressure conditions in the container.

In carrying out this invention in one illustrative embodiment thereof, an evacuable container is provided which is capable of being evacuated by pump which is removably attached thereto, wherein the container comprises a cover having a removable valve mounted therein and a container body adapted to receive the cover. First and second cooperating means at the interface of the cover and the container body are provided for retaining a deformable indication means therebetween. The first and second cooperating means are movable relative to each other whereby the extent of such movement is dependent upon the pressure difference between the interior and the surroundings of the container. Thereby, the deformation of the indication means and the relative position of the cover and container provides an indication of the amount of pressure in the container.

In a preferred form, the cover is provided with a socket having a channel therethrough which is adapted to sealably receive a stopper having a one-way valve therein which stopper is adapted to sealably receive a removable pump thereon for evacuating the container body through the stopper in the cover when the cover is positioned thereon. The indication means may be in the form of deformable ring thereon which is visible from the exterior of the evacuated container at least until the container is subjected to evacuation.

BRIEF DESCRIPTION OF THE DRAWINGS

The invention, together with further objects, aspects, advantages, and objects thereof will be more clearly understood from the following description taken in connection with the accompanying drawings which are illustrative only and are not necessarily drawn to scale.

DESCRIPTION OF THE PREFERRED EMBODIMENTS

Figure 1:
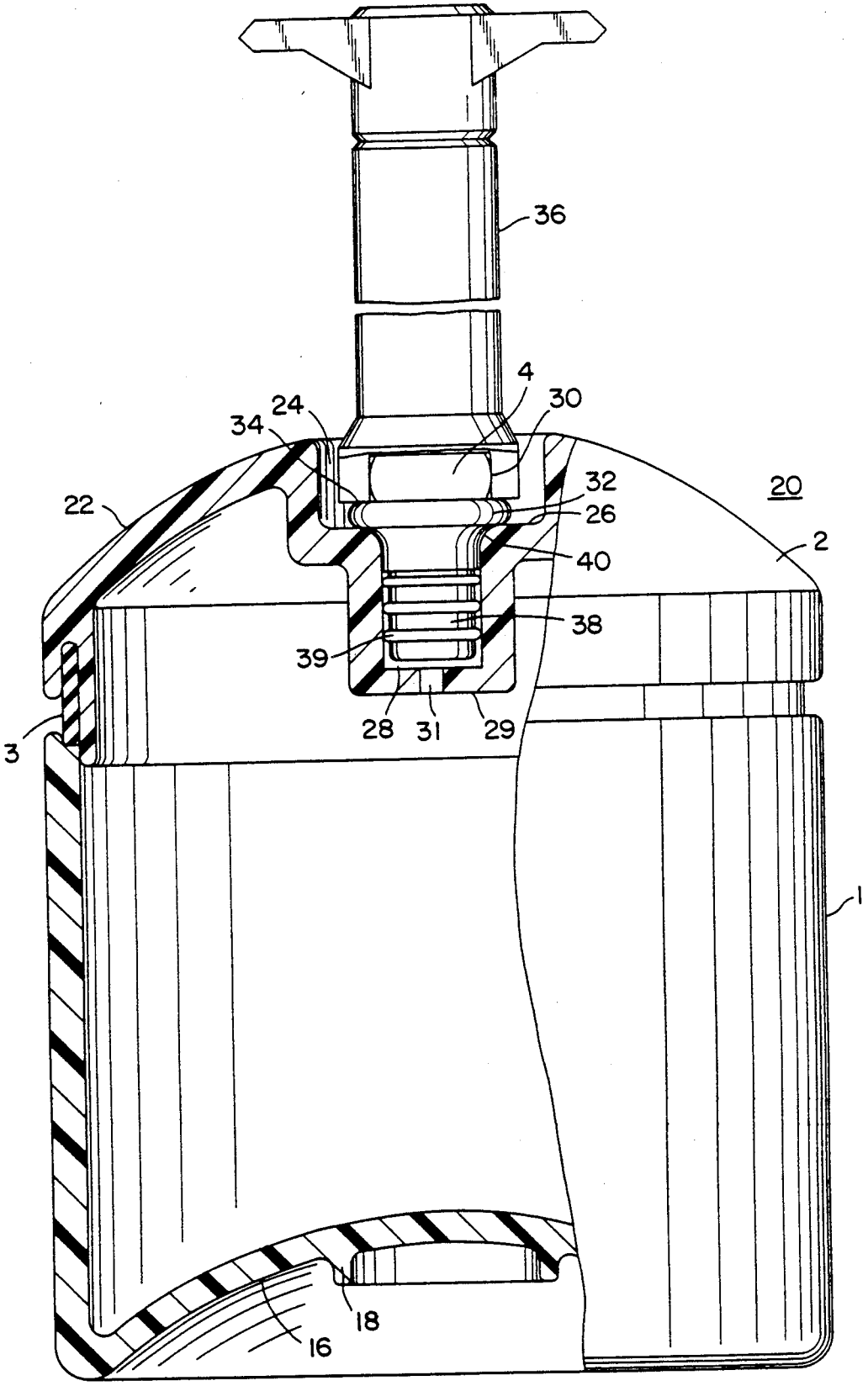
FIG. 1 is a front elevational view, partly in section and partly broken away, of a container in accordance with the present invention showing a hand pump positioned on a removable stopper mounted in a socket in the cover of the container for the evacuation thereof.

Referring now to FIG. 1, a container referred to generally with the reference numeral 20, comprises a generally cylindrical container body 1 which is intended to receive products such as foodstuffs, chemicals, paints or the like, and a cover 2 which is adapted to be applied to the container body 1. A deformable indication member 3 positioned between the cover 2 and the container body 1 is provided for sealably securing the cover 2 on the container body 1 when the container 20 is evacuated as will be explained hereinafter and for also providing an indication of the pressure difference between the interior of the container 20 and the ambient pressure of its surroundings.

The container 20 as shown in FIG. 1, is intended to be capable of being evacuated. To this end, the cover 2 is provided with a one way valve 4 through which air can be removed from the interior of the container 20. The one way valve 4 is preferably in the form of a plug or stopper, for example, of the type as shown and described in European Patent No. 0.234.607. In order to accommodate the removable stopper 4, a socket 24 is provided in the cover 2 having an annular shelf 26 thereon and a central channel 28 therethrough terminated in a bottom wall 29 having a central opening 31 therethrough. The bottom wall is not necessary but limits the exposure of the stopper to the contents of the container.

The one way valve stopper 4 has an upstanding tapered wall 30 extending therefrom and an annular flange 32 at the base of the tapered wall forming an annular shelf 34, the tapered wall and annular flange together accommodating a pump 36 such as the hand-operated pump as described in the aforesaid European Patent Application or any other type of mechanical or electrical pump. The pump cooperates with the one-way valve in the stopper to remove the air from the interior of the container 20 when the pump 36 is operated while sealably frictionally engaged with the tapered upstanding wall 30 of the stopper 4. The stopper 4 has a hollow body 38 joined by a flared portion 40 to the lower side of the annular flange 32 such that the stopper 4 is sealably mounted in the socket 24 of the cover 2. More particularly, the stopper body 38 is inserted in the channel 28 with the annular flange 32 resting on the annular shelf 34 and the flared member 40 engaging the channel 28 and the shelf 26. The body portion 38 has annular ribs 39 which also engage the interior of the channel 28 to sealably position the stopper in the socket 24 such that air can be removed from the interior of the container 20 through the stopper valve by operating the pump in a manner described in the aforesaid European Patent.

As will be seen in FIG. 1, the bottom 16 of the container body 1 has a concave configuration with a centrally located alignment ring 18 protruding therefrom. The cover 2 has a complimentary convex configuration 22 which accommodates the bottom 16 with the alignment ring 18 fitting within the socket 24 in the lid or cover 2 permitting the stacking of the containers 20 for the purpose of displaying, transporting and/or storing a plurality of such stacked containers.

Figure 2:
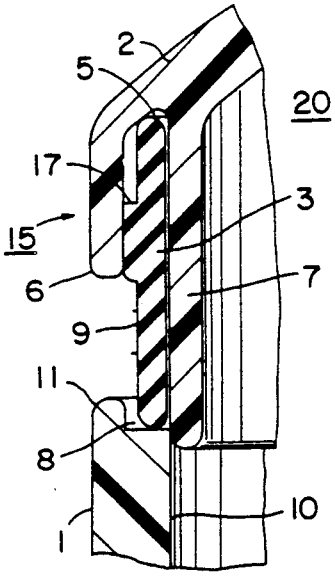
FIG. 2 is an enlarged partial cross-sectional view illustrating one embodiment of an indication means positioned between the cover and container body as shown in FIG. 1 with the container in a non-evacuated, unloaded condition.
Figure 3:
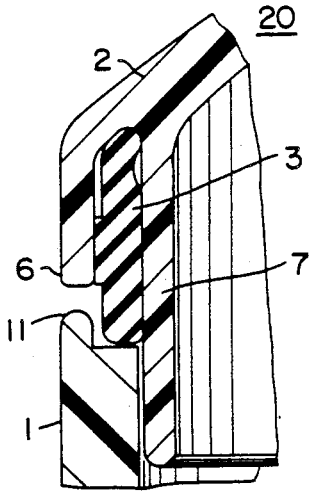
FIG. 3 is a cross-sectional view of the positioning of the indicator as illustrated in FIG. 2 with the container being at least partially evacuated.
Figure 4:
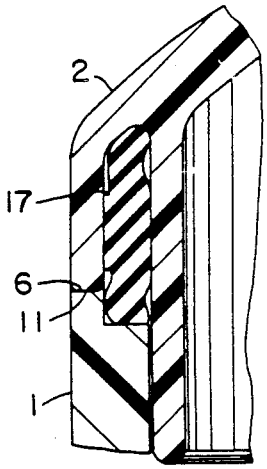
FIG. 4 is a cross-sectional view illustrating the positioning of the indicator means between the cover and container body similar to FIGS. 2 and 3 with the indicator member being under full load and the container being fully evacuated.

The deformable indication member 3 comprises a means which is deformable when loaded such that the extent of the deformation represents a visual indication of the pressure difference between the interior of the container 20 and its surroundings. As will more clearly be seen from the enlarged partial views as shown in FIGS. 2–4, the cover 2 of the container 20 has a U-shaped wall member, referred to generally with the reference numeral 15 having a recess 5 defined between a short outer leg 6 and a longer inner leg 7. The recess 5 at least partially accommodates the positioning of the indication member 3 therein. The U-shaped peripheral wall member 15 extends around the circumference of the cover 2 and cooperates with a circumferential, peripheral ridge 11 and a recess 8 formed on the upper edge of the container sidewall, to accommodate the receipt and retention of the deformable indication member 3. Thus, in the configuration shown in FIG. 2, the indication member 3 has one side thereof positioned or locked in the recess 5 while the other side of the indicator member 3 is centered in and held in the recess 8 of the container body 1. The longer leg 7 centers the cover on the container body and supports the member 3 against being drawn into the container as a partial vacuum is developed.

The indication member 3 can be provided with a scale 9 thereon which is clearly visible outside the container by viewing the scale 9 of the deformable indication member 3 between the shorter leg 6 extending downwardly from the lid and the ridge 11 of the container body 1. In the embodiment shown in FIGS. 2–4, the indication member 3 is releasably accommodated between the recesses 5 and 8 in the cover 2 and container body 1, respectively. The indication member 3 comprises a deformable ring which may, for example, be made of any material which can be deformed by evacuating the container and which returns to its original configuration when the vacuum is released e.g. a synthetic rubber such as Evoprene 967. A step configuration 17 is preferred to aid in the deformation and sealing function as well as the rapid return to the rings' original configuration once the vacuum is removed.

In operation, the cover 2 is placed on top of the container body 1 with the indication member 3 positioned therebetween in the recesses 5 and 8 of the cover 2 and container body 1, respectively. The one-way valve stopper 4 is inserted in the socket 24 of the cover 2 and the pump 36 is placed in sealing engagement on the stopper 4, as illustrated in FIG. 1. In the position of the cover 2 relative to the container body 1 as shown in FIG. 2, little or no evacuation or under pressure has been created in the container 20 and accordingly, the outer leg 6 of the U-shaped wall member 15 is positioned at some distance from the upper end of the ridge 11 of the container body 1. As a result, a substantial part of the indication member 3 as well as the scale 9 if provided thereon is clearly visible from the exterior of the container 20 when viewing the indication member 3 between the outer leg 6 of the cover 2 and the ridge 11 of the container body 1. When the pump 36 is in position and operated, creating an under pressure or partial vacuum in the container 20, the cover 2 moves toward the container body 1 as is illustrated in FIG. 3. Still referring to FIG. 3, the distance between the end of the outer leg 6 and the uppermost end of the ridge 11 of the container body 1 has been substantially reduced so that only a small part of the scale 9 is still visible from the exterior of the container 20. The indication member 3 that was initially accommodated with clearance in the recess 5 and the recess 8 has been deformed in these recesses into a shorter, deformed configuration. In the position shown in FIG. 3, only a small part of the scale 9 is visible, and this represents a clear visual indication of the degree of evacuation or under pressure now present in the container 20. It will be apparent that a clear visual representation of the amount of evaluation is provided whether a scale is present or not. The shape and the dimensioning of the container 20 can also be such that the leg 6 completely engages the ridge 11 of the container 1 if a certain value of evacuation or under pressure is present in the container 20. In such a case, the indication member 3 is simply not visible from the exterior of the container. A container and indication means so shaped is an easy way to indicate that the container is fully evacuated when the indication member 3 is not visible from the exterior of the container. It should also be clear from the embodiments of FIGS. 2–4 that the indication member 3 also functions as a sealing member between the cover 2 and the container body 1. The compression of the indication means 3 flattens the step 17 horizontally forcing the means 3 to come into contact with the legs 6 and 7 as well as bending and compacting the upper and lower extremeties of the indication means to provide a complete seal between the cover and container.

As appears clearly from FIGS. 2–4, the outer leg 6 of the U-shaped peripheral wall member 15 is shorter than the inner leg 7 of the U-shaped wall member. The outer leg 6 is substantially in alignment with the upstanding ridge 11 on the container body 1 when the cover 2 is positioned on the container body 1. The inner leg 7 is inwardly offset from the wall 10 of the container body 1 and is guided by the inner surface of the wall 10 to align the cover and body.

It will be apparent that the structures may be reversed, with the U-shaped wall structure formed upstanding from the container body 1 and the cooperating structure of the ridge 11 and recess 8 being in the cover 2. In addition, the outer leg 6 may be transparent so that the indication member 3 remains visible through the leg for indicating the pressure, if desired.

Figure 5:
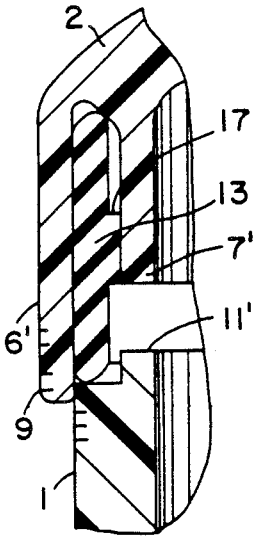
FIG. 5 is a cross sectional view of another embodiment similar to the embodiment of FIGS. 2–4 in which the indicator means in reversed and the long offset leg of the cover overlies the outer surface of the container.

As will be seen in FIG. 5, an inverted embodiment of that shown in FIGS. 2–4 is provided. In FIG. 5, the outer leg 6' is longer and offset outside the outer surface of container 1. The inner leg 7' is shorter and in alignment with ridge 11' of the container 1. Also, the indicator means 3 can be reversed with the step 17 facing the inner leg 7'. The operation is the same as in the embodiment of FIGS. 2–4. FIG. 5 illustrates only the relative positions of the cover 2, indication means 3 and container 1 while no vacuum has been applied to the container. In this embodiment, if desired, a scale may be provided directly on the outer surface of the container and/or on the longer leg 6' when the longer leg is transparent. The benefit of using a scale in this configuration resides in the scale not being deformed which would distort the scale when positioned on the indication means 3 in the previous embodiment.

Figure 6:
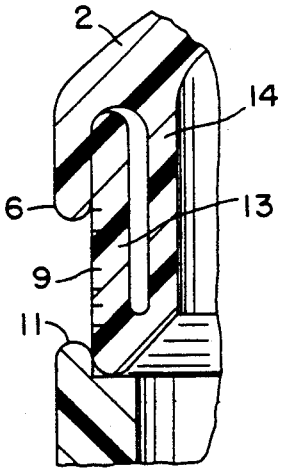
FIG. 6 is a cross-sectional view of another embodiment of the positioning of the indicator means of the invention whereby the indicator means forms an integral part of the cover and is shown in FIG. 6 under a non-evacuated, no-load condition.
Figure 7:
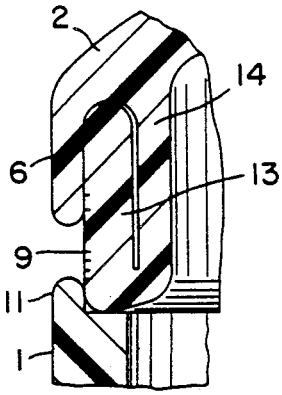
FIG. 7 is a view of the integral cover indicator means of FIG. 6 shown under partial load with the container being at least partially evacuated.

Referring now to FIGS. 6 and 7, there is shown another embodiment of the container 20 according to the present invention. An indication member 13 is provided which is integral with the longer leg 14 of the cover thus making indication member 13 an integral part of the cover 2. In the position shown in FIG. 6, there is little or no evacuation in the container 20. When evacuating or applying an under pressure in the container 20, the condition as illustrated in FIG. 7 is obtained. As is shown in FIG. 7, the outer leg 6 of the cover 2 is drawn downwardly and closer to the container body 1 as compared to the position illustrated in FIG. 6. Accordingly, the scale 9 of the indication member 3 is visible between the shorter leg 6 of the cover 2 and the ridge 11 of the container body 1 providing an indication of the condition of the interior of the container with respect to pressure. As discussed above with respect to the embodiments of FIGS. 1–4, it is possible to design the container 20 such that when the desired evacuation is reached, the outer leg 6 completely engages the ridge 11 of the container body 1 so that indication member is not visible. In FIG. 5, inner leg 7' would completely engage ridge 11' which could be apparent from a scale on leg 6' or the outer surface of container 1.

In accordance with the present invention, cooperating sections of two container members have indication means which indicate the pressure difference between the interior of the container and its surroundings. As a result, the user is provided with a very simple check as to whether or not the desired pressure difference between the interior of the container and its surroundings are still present. The particular indication is provided by a deformable member with the extent of deformation offering a direct indication of the internal pressure difference between the interior of the container and its surroundings. A scale can also be provided cooperating with the container members such that the magnitude of the pressure difference between the interior and its surroundings are well-defined and at the same time, the indication member acts as a complete seal for retaining the evacuated state of the container. The provision of a separate stopper simplifies the structure of the container cover and uses a readily obtainable commercial stopper marketed by Vacu-Products of The Netherlands along with a cooperating hand pump sold under the trademark VACU-VIN. The removal of the stopper also permits ease of cleaning of the container as well as the stopper.

Since other changes and modifications vary to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A container capable of being evacuated by a pump which is capable of being removably sealably attached thereto comprising:

a cover having a valve mounted therein, said valve adapted for sealing engagement with a removably pump;

a container adapted to receive said cover;

a deformable indication sealing means positioned between said cover and said container body when said cover is positioned on said container body, said deformable indication sealing means being at least partially directly visible by an observer from outside said container when said container is not properly evacuated;

first and second cooperating means defined by said cover and said container body at the interface thereof for retaining said deformable indication sealing means therebetween in an at least a partially visible position as viewed externally of said container by an observer when said container is in a non-evacuated condition;

said first and second cooperating means being movable relative to each other when said container is being evacuated, the extent of such movement being dependent on the pressure difference between the interior and the surroundings of said container whereby said deformable indication sealing means is at least partially visible from the exterior of said container when said container is not properly evacuated and said deformable indication sealing means is not directly visible from the exterior of said container when said container is properly evacuated.

2. The container as claimed in claim 1 wherein said cover is provided with a socket having a channel opening therethrough providing air communication with the interior of said container body when said cover is positioned on said container body, and said valve is sealably positioned in said socket.

3. The container as claimed in claim 2 wherein said valve is part of a stopper adapted to be removably mounted in said socket.

4. The container as claimed in claim 3 wherein said socket has an annular shelf therein and said stopper has an annular flange adapted to be positioned on said shelf when said stopper is inserted into said socket.

5. The container as claimed in claim 1 wherein said deformable indication sealing means is in the form of an annular ring and means for indicating the amount of deformation to which said ring has been subjected when said container is being evacuated.

6. The container as claimed in claim 1 wherein at least one of said first and second cooperating means has a recess therein accommodating a portion of the deformable indication sealing means and thereby positioning said deformable indication means for engagement with the other of said first and second cooperating means.

7. The container as claimed in claim 1 wherein one of said first and second cooperating means includes a wall member having a U-shaped cross section defining a recess therein for accommodating a portion of said deformable indication sealing means.

8. The container as claimed in claim 7 wherein said U-shaped cross section of the wall member is formed by two legs, one of which is shorter than the other leg.

9. The container as claimed in claim 8 wherein said shorter leg is in alignment with the other cooperating means and the longer leg is off-set inwardly with respect to said other cooperating means, the longer leg fitting within the container or cover and serving to align the container and cover.

10. The container as claimed in claim 9 wherein the other cooperating means includes a ridge and an adjacent recess, wherein the deformable indication sealing means engages and seals to the recess.

11. The container as claimed in claim 10 wherein said shorter leg contacts said ridge when a substantial degree of evacuation of the container has been attained.

12. The container as claimed in claim 9 wherein said shorter leg contacts said other cooperating means when a substantial degree of evacuation of the container has been attained.

13. The container as claimed in claim 1 wherein said deformable indication sealing means forms an integral part of said cover.

14. The container as claimed in claim 2 wherein said container body has a bottom with a concave configuration and an alignment means positioned centrally thereon which alignment means fits inside the periphery of said socket in said cover, said cover has a convex configuration complementary with said concave bottom with the socket centrally positioned to receive the alignment means for facilitating the stacking of said containers.

15. A container adapted for evacuation by a pump removably attached thereto comprising:

a cover having a one way valve therein for permitting the removal of air therethrough;

a container body adapted to receive said cover thereon for enclosing said container body;

said cover and said container body have recesses therein which are in alignment when said cover is positioned on said container body for retaining and centering a deformable indication sealing means therebetween;

a deformable indication sealing means mounted between said cover and said container body for sealing said cover to said container body when said container is evacuated and for visually providing an indication from the exterior of said container of the amount of evacuation in the interior of said container based on the amount of deformation of said indication sealing means;

at least one of said recesses is formed in a wall of U-shaped cross-section having a long outer leg and a shorter inner leg and the other recess has an inner peripheral ridge thereon separated from and in alignment with said shorter leg of said U-shaped wall; and said cover contains a scale for indicating the amount deformation to which said deformable indication sealing means has been subjected when said container is being evacuated.

16. A container adapted for evacuation by a pump removably attached thereto comprising:

a cover having a one way valve therein for permitting the removal of air therethrough;

a container body adapted to receive said cover thereon for enclosing said container body;

said cover and said container body have recesses therein which are in alignment when said cover is positioned on said container body for retaining and centering a deformable indication sealing means therebetween;

a deformable indication sealing means mounted between said cover and said container body for sealing said cover to said container body when said container is evacuated and for visually providing an indication from the exterior of said container of the amount of evacuation in the interior of said container based on the amount of deformation of said indication sealing means;

at least one of said recesses is formed in a wall of U-shaped cross-section having a long outer leg and a shorter inner leg and the other recess has an inner peripheral ridge thereon separated from and in alignment with said shorter leg of said U-shaped wall;

said container body contains a scale for indicating the amount deformation to which said deformable indication sealing means has been subjected when said container is being evacuated.

* * * * *